US006862827B2

(12) United States Patent
Gregory

(10) Patent No.: US 6,862,827 B2
(45) Date of Patent: Mar. 8, 2005

(54) HOLDER FOR DISPLAYING TRAVEL RELATED DOCUMENTS

(75) Inventor: Corinne A. Gregory, Woodinville, WA (US)

(73) Assignee: The HartGregory Group, Woodinville, WA (US)

( * ) Notice: Subject to any disclaimer, the term of this patent is extended or adjusted under 35 U.S.C. 154(b) by 11 days.

(21) Appl. No.: 10/395,024

(22) Filed: Mar. 21, 2003

(65) Prior Publication Data

US 2003/0213156 A1 Nov. 20, 2003

Related U.S. Application Data

(60) Provisional application No. 60/366,742, filed on Mar. 22, 2002.

(51) Int. Cl.[7] ..... G09F 3/18

(52) U.S. Cl. ..... 40/661; 40/654.01; 40/586; 283/75; 150/147; 150/145; 224/600; 224/623; 224/257

(58) Field of Search ..... 40/661, 649, 654.01, 40/586; 283/75, 108, 109; 150/147, 148, 145, 149; 206/39; 224/191, 600, 623, 230, 683, 684, 249, 257

(56) References Cited

U.S. PATENT DOCUMENTS

| | | | | | |
|---|---|---|---|---|---|
| 2,544,618 | A | * | 3/1951 | Smith | 40/661.04 |
| 3,657,834 | A | * | 4/1972 | Tauber | 40/1.5 |
| 3,999,317 | A | * | 12/1976 | Owens | 40/1.5 |
| 4,416,315 | A | * | 11/1983 | Foley | 150/134 |
| 4,815,510 | A | * | 3/1989 | Edelist | 150/134 |
| 4,937,963 | A | * | 7/1990 | Barnes | 40/661.06 |
| 5,178,311 | A | * | 1/1993 | McBride | 224/191 |
| 5,217,056 | A | * | 6/1993 | Ritter | 150/147 |
| 6,073,378 | A | * | 6/2000 | Gabbert | 40/661 |
| 6,108,957 | A | * | 8/2000 | Zapawa | 40/654.01 |
| D479,647 | S | * | 9/2003 | Paura et al. | D3/215 |
| 6,681,972 | B1 | * | 1/2004 | Tapocik | 224/602 |
| 2001/0054245 | A1 | * | 12/2001 | Williams | 40/661 |
| 2002/0108284 | A1 | * | 8/2002 | Wallin | 40/586 |
| 2003/0188815 | A1 | * | 10/2003 | Hart | 150/147 |
| 2003/0201293 | A1 | * | 10/2003 | Hansen et al. | 224/600 |
| 2004/0040194 | A1 | * | 3/2004 | Arraut | 40/654.01 |

* cited by examiner

*Primary Examiner*—Gary C. Hoge
(74) *Attorney, Agent, or Firm*—Seed IP Law Group PLLC

(57) ABSTRACT

A holder for a carrying and displaying a variety of travel related documents. The holder has clear pockets where the travel related documents placed therein are easily accessible by the user, easily viewed by security and boarding personnel, and the documents securely retained both within the holder and by an attachment means to the traveler. The document holder may be configured with a variety of pockets, each pocket being coverable with a flap. The holder may be worn about the traveler with a lanyard directly attached to the document holder.

10 Claims, 5 Drawing Sheets

HOLDER FOR DISPLAYING TRAVEL RELATED DOCUMENTS

BACKGROUND OF THE INVENTION

1. Field of the Invention

The present invention relates to holder for carrying and displaying travel-related documents and credentials.

2. Description of the Related Art

Travelers often need to have their travel related documents and identification readily accessible. The events of Sep. 11, 2001 have created a heightened duty on all travelers, business and recreational alike; to have certain documents at the ready for clearing security check points and efficiently moving through boarding areas. The requisite travel documents may include, for example, an airline-boarding pass, a bus or train pass, a passport, photo identification, baggage claim tickets, military identification, and/or any other similar travel related document. These documents must be both easily accessible for handing over to the appropriate official and readily visible for security reasons.

Some examples of existing products for keeping and maintaining travel documents are such things as handbags, briefcases, pockets contained within shirt, pants, jackets, or the like, fanny packs, travel wallets and many more standard carrying devices. However, none of these products offers easy access to the documents or makes the documents readily visible while a traveler moves from one destination to the next.

BRIEF SUMMARY OF THE INVENTION

The present invention relates to a holder for carrying and displaying travel credentials such as a boarding pass, passport, photo identification, etc. where the travel documents may be placed in separate, clear pockets to be readily viewed by security officers, boarding gate personnel, or some other authorized official. In the embodiments described herein, the secure travel document holder of the present invention may have flaps for securing the various pocket openings. The holder may be worn by a traveler and may even be enclosed in a privacy cover in the event the traveler does not want to readily display the personal travel information. Optionally, a traveler may use backing material to cover one side, such as the backside of the device, to keep certain information from view. However, once the traveler has the need, the privacy cover can be quickly opened to display the holder with the requisite documents in plain view of the authorized official. The present invention is not limited to the specific embodiments illustrated herein, but may be accomplished in a wide variety of ways such as multiple pockets, various sized pockets, covered pockets, side-opening pockets, stacked pockets, etc. The present invention provides travelers with a practical and manageable way to readily display their travel related documents which will allow travelers to more quickly negotiate security check points, check-in, and boarding.

DETAILED DESCRIPTION OF THE INVENTION

The present invention is generally directed toward a holder for carrying and displaying travel credentials, and the like. Travel credentials may include, for example, an airline-boarding pass, a bus or train pass, a passport, photo identification, baggage claim tickets, military identification, and/or any other similar travel related document. Additionally, travel credentials may also include documents such as event credentials, event badges, event tickets, and the like which may be branded with the name of the sponsor or even bar coded for security seating purposes. The document holder can provide a convenient; yet secure method for carrying travel documents around airports and similar travel hubs. The holder permits the documents contained therein to be easily shown to security, airline, or other authorized personnel without the traveler resorting to searching their briefcase, purse, pockets, or other places where the documents would typically be placed while en route to their next destination. Since the present invention permits the traveler to "wear" the document holder, the traveler's credentials can be kept in secure and close proximity to the traveler's person while still providing ready access.

The several embodiments of the present invention discussed herein are primarily comprised of a central sheet of material, a first pocket, optional additional pockets, and an attachment means for permitting the traveler to "wear" the document holder. The first pocket can be made from transparent material attached to one side of the central sheet for securely holding documents such as an airline-boarding pass. Additional pockets for securely holding such items as a passport or driver's license can also be made from transparent material and attached to the opposite side of the central sheet or stacked onto the outside of the first pocket. A pocket, as described in the embodiments herein, is attached to adjacent material along at least two of the pocket edges thereby leaving at least one edge of the pocket unattached.

Figure 1:
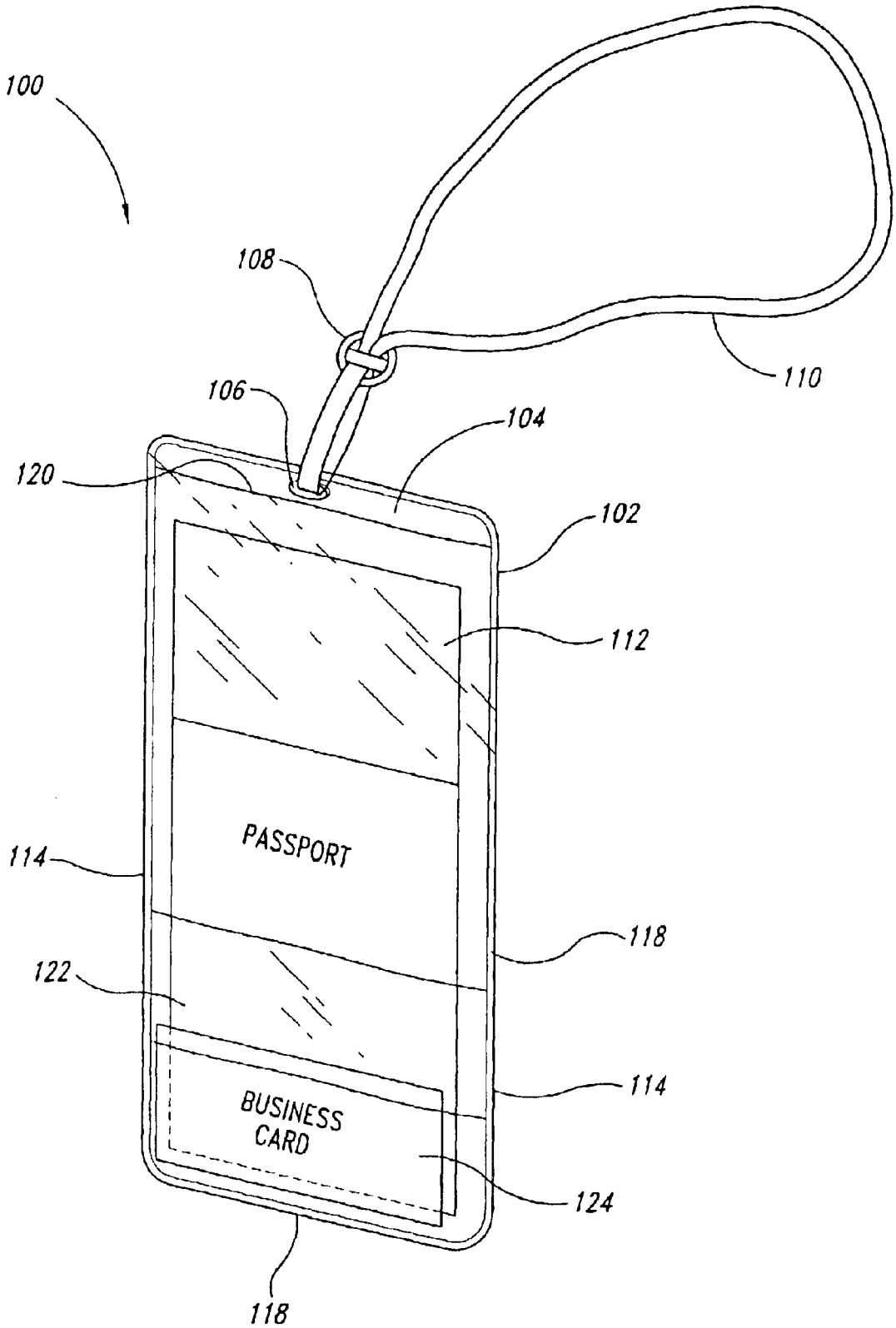
FIG. 1 is a front-side, isometric view of one embodiment of a holder.
Figure 2:
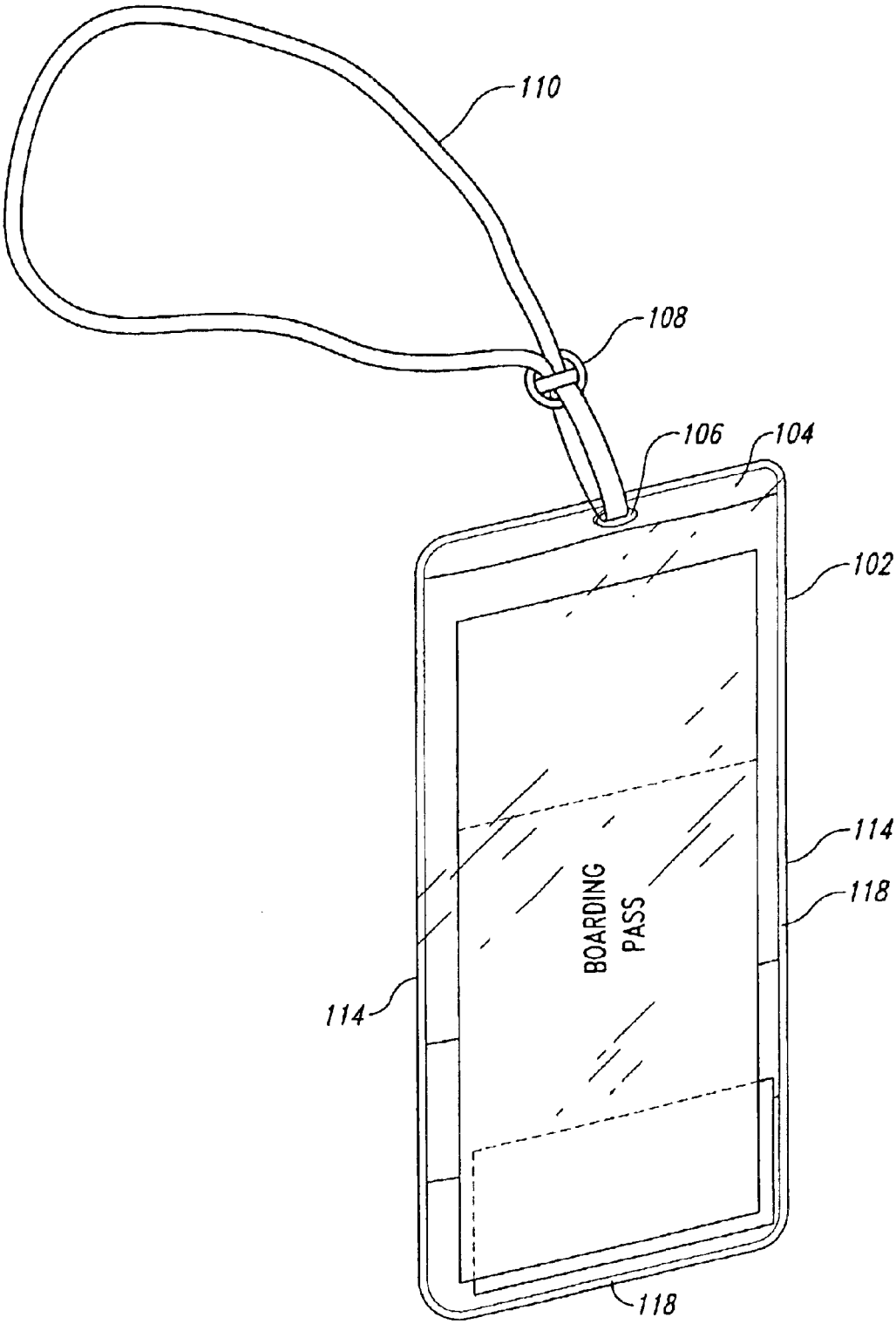
FIG. 2 is a backside, isometric view of the holder of FIG. 1.

FIGS. 1 and 2 illustrates one embodiment of the present invention. FIG. 1 depicts a document holder 100 formed about a central sheet 102, typically rectangular in shape and may be fabricated from clear plastic, vinyl, Lexan, Lucite, Acrylic, or any other similar material. The central sheet 102 should be sufficiently rigid to allow the holder 100 to maintain its relative shape and to permit easy insertion and retrieval of travel credentials. A top portion of the central sheet 102 may have a reinforcement region 104 with a cutout 106 for attaching a clipping mechanism 108 and lanyard 110 thereto. The reinforcement region 104 may be created when forming the central sheet 102 by making that region 104 thicker than the rest of the central sheet 102, as shown in the illustrated embodiment. Alternatively, adhering other material to the central sheet 102 may form the reinforcement region 104. The lanyard 110 allows the traveler to wear the holder about their neck or shoulder. Optionally, the reinforcement region 104 may be used to attach a reel-style clip or belt clip such that the clip permits the holder to be attached to the traveler's clothing. After having reviewed the disclosure, one of ordinary skill in the art will understand that the holder can be "worn" by the traveler in a variety of ways. For example, the clip mechanism can be directly connected to the traveler's clothing, duffle bag, purse handle, etc.

The first pocket 112 may be similar in shape to the central sheet 102 and sized to receive a document such as an airline boarding pass. The first pocket 112 may be attached to the central sheet 102 by any number of standard methods such as thermal bonding, adhesive, rivets, press molding, or sewn. In the illustrated embodiment, the first pocket 112 is press molded to the central sheet 102 along two elongated sides 114 and one shorter side 116 to create a border region 118. A first pocket opening 120 for the insertion or retrieval of travel credentials is located opposite from side 118. The first pocket 112 may be fabricated from clear plastic, vinyl, Lexan, Lucite, Acrylic, or any other similar material that allows the important document information to be visible through the first pocket 112.

As seen in the illustrated embodiment, additional pockets of varying sizes may be layered onto the first pocket 112. For example, a second pocket 122 may be formed on top of the first pocket 112 and sized for receiving and securing a document such as a passport. Additionally, a third pocket 124 may then be formed on top of the second pocket 122 and sized for receiving and securing a document such as a business card or driver's license. The applicant appreciates that each pocket opening may be closed by a variety of fastening means such as a zipper, button, Velcro tab, snaps, etc.

FIG. 2 depicts the backside of the present embodiment of the holder 100 from FIG. 1. If the central sheet 102 is made from clear material, then the document located in the first pocket 112 may be inserted therein such that the important information on the document may be viewed through the backside of the central sheet 102 and not obscured by documents being retained in the additional pockets 122 and 124.

Because the traveler is required to display their boarding pass and photo identification at the curbside check-in, ticket counter, security checkpoints, boarding gate, immigration, and customs, for example, the traveler simply has to "wear" the holder 100 to readily display the requested document.

The present invention eliminates the hassle of searching through bags, purses, etc. at various travel destinations. Further, the present invention can be used hands free. For example, a traveler carrying a carry-on bag in one hand and holding a child in the other arm can place the requisite boarding gate documents in the holder 100 and permit the boarding agent to quickly remove, check, and re-insert the documents. The clear plastic materials used with the document holder 100 have the advantage of allowing the documents to be scanned with a bar code scanner, for example, without removing the documents from the holder 100.

Figure 3:
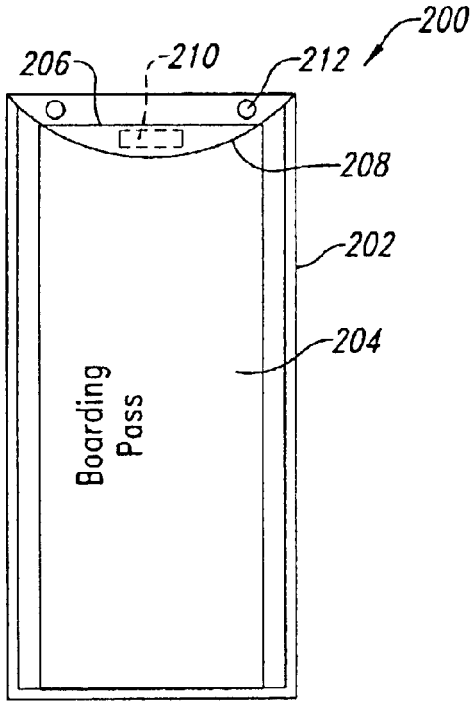
FIG. 3 is a front-side view of a holder according to an alternate embodiment of the present invention.
Figure 4:
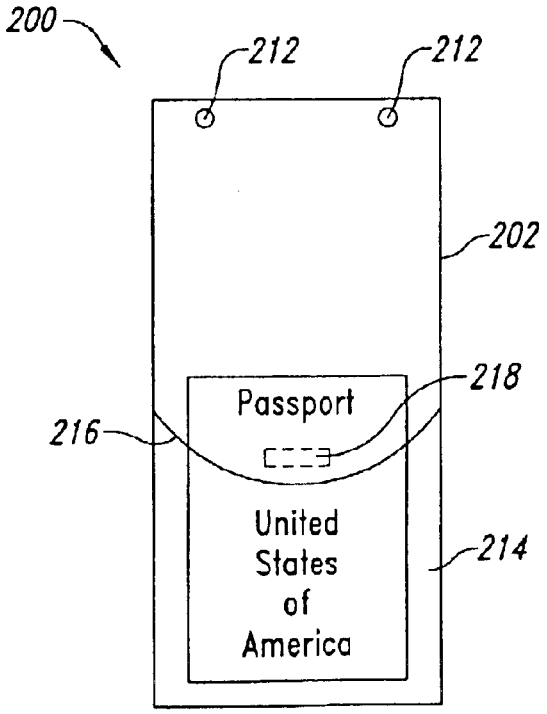
FIG. 4 is a backside view of a holder according to the alternate embodiment of FIG. 3.

FIGS. 3 and 4 illustrates another embodiment of the document holder 200. FIG. 3 depicts the front side of a document holder 200 formed about a central sheet 202. The central sheet 202 may be opaque and made from plastic, cardboard, or other similar material, or a composite material such as fiberglass. The central sheet 202 may also be covered or canvassed with leather, cloth, or leather-like material to give the holder an "executive" style look. Additionally, cardstock or other similar material may be used to give the holder a personalized look while permitting the documents to be displayed through the holder.

The first pocket 204 may be similar in shape to the central sheet 202 and sized to fit thereon. The first pocket opening 206 may be securely closed with a flap mechanism 208. The flap mechanism 208 may be fastened to the first pocket 204 with a Velcro tab 210, the tab 210 having mating counterparts (not shown) attached to the first pocket 204 and the central sheet 202, respectively. However, after having reviewed the disclosure, one of ordinary skill in the art will understand that the flap mechanism 208 can be closed by a variety of means such as a buttons, tacky adhesive, or a releasable clip, for example. The flap mechanism 208 may also be shaped in a variety of ways such as rounded, envelope-style, box style, or other styles.

The illustrated embodiment also depicts two through holes 212 as an alternate way of attaching the lanyard. Again, after having reviewed the disclosure, one of ordinary skill in the art will understand that the holder can be "worn" by the traveler in a variety of ways.

FIG. 4 depicts the backside of the present embodiment of the holder from FIG. 3. Attached to the backside of the central sheet 202 can be a second pocket 214. The second pocket 214 may be formed with the central sheet 202 in a manner similar to that used to attach the front pocket 204 discussed above. Likewise, the second pocket 214 may have different dimensions for releasably receiving a document such as a passport. Additionally, the second pocket 214 can be securely closed, like the first pocket 204, with a flap mechanism 216 having a fastening means 218 for attaching to the flap 216 to the outer surface of the second pocket 214. The advantage of having a flap mechanism is to securely cover the pocket opening.

Figure 5:
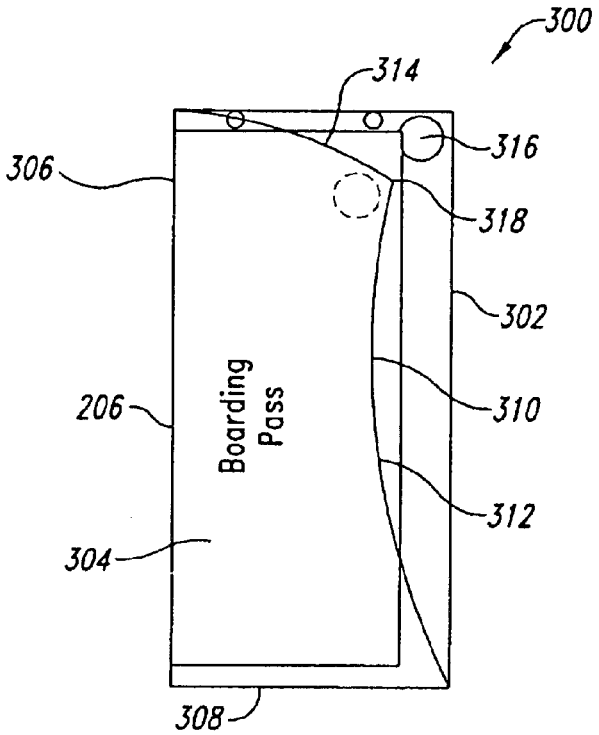
FIG. 5 is a front-side view of a holder according to another alternate embodiment of the present invention.
Figure 6:
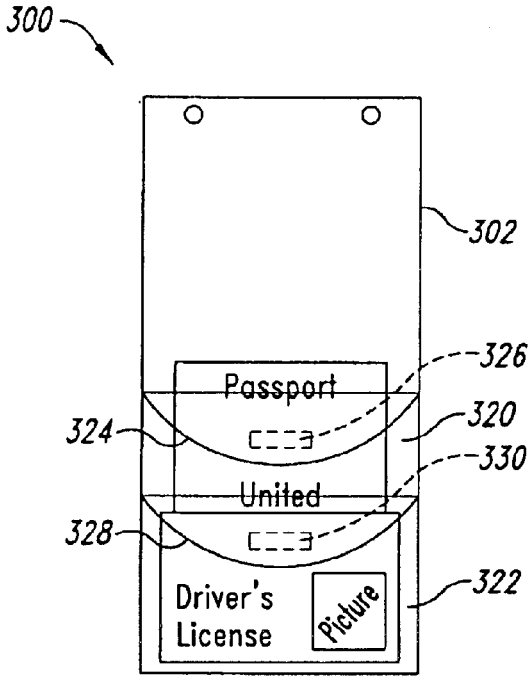
FIG. 6 is a backside view of a holder according to the alternate embodiment of FIG. 5.

FIGS. 5 and 6 illustrate another alternate embodiment of the present invention. FIG. 5 depicts the front side of the alternate embodiment having a first pocket 304, similar in shape to the central sheet 302 and sized to fit thereon, attached to the central sheet 202 along one elongated side 306 and one shorter side 308. A first pocket opening 310 is formed by the unattached first pocket edges 312 and 314. This type of pocket configuration may be securely attached to the central sheet 302 with a fastening means 316 located at the common corner 218 where the first pocket edges 312 and 314 meet. However, one of ordinary skill in the art will understand that the first pocket 304 as configured in the present embodiment can be closed by a variety of means such as a zipper, Velcro tab, snaps, or other standard fastening means, for example.

FIG. 6 depicts the backside of the present embodiment of the holder from FIG. 5. Attached to the backside of the central sheet 302 can be a second pocket 320 and a third pocket 322. The second pocket 320 may be formed with the central sheet 302 by any of the variety of means previously discussed. Likewise, the second pocket 320 may have dimensions sufficient for releasably receiving a document about the size of a passport. Additionally, the second pocket 320 can be securely closed with a flap mechanism 324 having a fastening means 326 for attaching to the flap 324 to the outer surface of the second pocket 320.

The third pocket 322 may be formed with the edges of central sheet 302 and on top of the second pocket 320 by any of the variety of means previously discussed. The dimensions of the third pocket 322 may be sufficient for releasably receiving a document about the size of a business card or driver's license, for example. Additionally, the third pocket 322 can be securely closed with a flap mechanism 328 having a fastening means 330 for attaching to the flap 328 to the outer surface of the third pocket 322.

Figure 7:
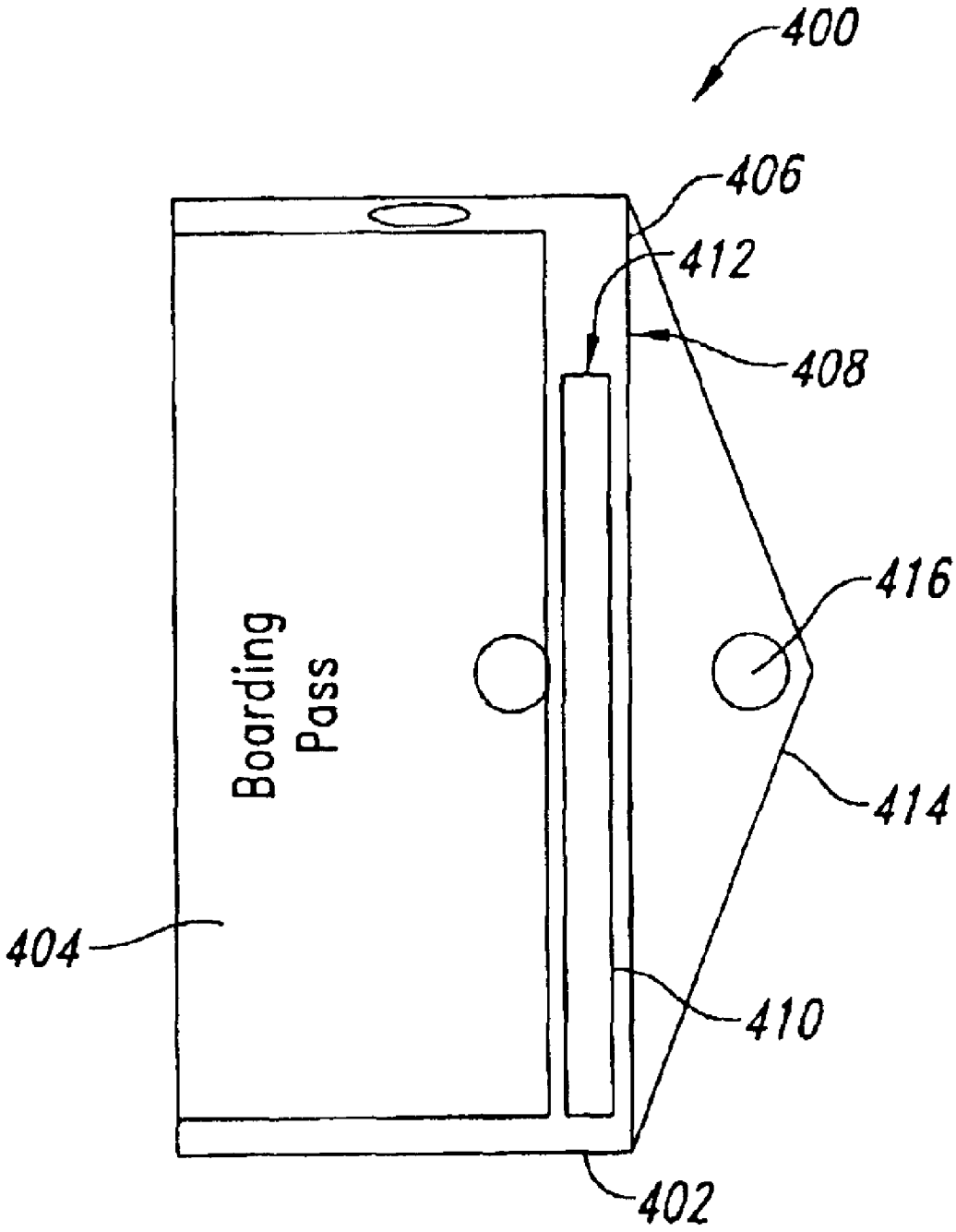
FIG. 7 is a front-side view of a holder according to another alternate embodiment of the present invention.

FIG. 7 illustrates the front side of another alternate embodiment of the present invention. In the illustrated embodiment, a pocket 404 attached to a central sheet 402 can have a pocket opening 406 located along an elongated side 408 of the holder 400. In addition, the holder 400 can have a sleeve 410 attached thereon for receiving a writing utensil. Both the sleeve opening 412 and the pocket opening 406 may be securely covered with a flap mechanism 414. The flap mechanism 414 can be attached to the outer surface of the pocket 404 by any of the variety of attachment means 416 previously discussed. The backside of the present embodiment can be fabricated in a manner similar to any of the foregoing embodiments discussed herein.

The applicant appreciates that the various embodiments discussed herein may be combined in a variety of ways, including additional pockets added to the holder. The pocket openings permit a traveler to easily insert and remove the requisite travel documents. Additionally, the present invention may be slid into a properly sized privacy cover that can easily be flipped open to display the travel documents located in the pockets of the holder. The privacy covers, for example, may be made with an executive style look in a variety of colors and patterns.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A holder for carrying and displaying travel documents comprising:

a central sheet of material;

a first clear pocket attached to the central sheet, an unattached portion of the pocket configured for releasably receiving a travel related document such as an airline boarding pass;

at least one additional clear pocket attached to the central sheet, an unattached portion configured for releasably receiving another travel related document such as a passport, wherein the additional clear pocket is attached to a front side of the central sheet, the additional clear pocket located on the outside surface of and adjacent to the first pocket; and an attachment means for affixing the holder to a traveler.

2. The holder of claim 1 wherein the first clear pocket is attached to a front side of the central sheet and the second clear pocket is attached to a back side of the central sheet.

3. The holder of claim 1 wherein the unattached portion resembles a slit for releasably receiving the documents.

4. The holder of claim 1, further comprising a flap mechanism to substantially cover the slit.

5. The holder of claim 4 wherein the flap mechanism is integrally formed with the central sheet.

6. The holder of claim 4 wherein the flap mechanism is fastened to at least a portion of the central sheet.

7. The holder of claim 1 wherein the unattached pocket portion of at least one of the pockets is configured with a fastening means for fastening the unattached pocket portion to the central sheet for secure retention of any documents placed therein.

8. The holder of claim 7 wherein the flap mechanism fastening means comprises a Velcro tab.

9. The holder of claim 1 further comprising another elongated pocket attached to the central sheet adjacent to the first pocket for releasably receiving a writing utensil.

10. The holder of claim 1 wherein the attachment means is at least one cutout through a reinforced top end of the central sheet for a lanyard to be attached, the lanyard permits the holder to be worn about the traveler's neck or over the traveler's shoulder.

* * * * *